United States Patent [19]

Hoshino et al.

[11] Patent Number: 4,529,391

[45] Date of Patent: Jul. 16, 1985

[54] TOY HAVING TWO MODES OF LOCOMOTION

[75] Inventors: Shiro Hoshino; Teruo Nikaido, both of Tokyo, Japan

[73] Assignee: Tomy Kogyo Company, Incorporated, Japan

[21] Appl. No.: 616,061

[22] Filed: Jun. 1, 1984

[30] Foreign Application Priority Data

Jun. 6, 1983 [JP] Japan ..... 58-86100

[51] Int. Cl.[3] ..... A63H 3/22; A63H 17/16

[52] U.S. Cl. ..... 446/356; 446/440; 446/463; 446/487

[58] Field of Search ..... 446/356, 353, 355, 294, 446/289, 293, 290, 440, 463, 462

[56] References Cited

U.S. PATENT DOCUMENTS

| | | | |
|---|---|---|---|
| 2,978,834 | 4/1961 | Gardel et al. | 446/356 X |
| 4,170,840 | 10/1979 | Ogawa | 446/356 |
| 4,183,173 | 1/1980 | Ogawa | 446/356 |
| 4,206,564 | 6/1980 | Ogawa | 446/356 |

FOREIGN PATENT DOCUMENTS

| | | | |
|---|---|---|---|
| 133168 | 5/1933 | Austria | 446/356 |
| 1229688 | 4/1971 | United Kingdom | 446/356 |

*Primary Examiner*—Mickey Yu
*Attorney, Agent, or Firm*—K. H. Boswell

[57] ABSTRACT

A toy having two modes of locomotion includes a body having a fly wheel rotatably mounted thereon. A further wheel is also rotatably mounted on the body. A plurality of appendage members each having ends are also mounted to the body about one of their ends. The appendage members are movable on the body between a retracted and extended position. When in the retracted position, the body is supported on a support surface by the fly wheel and the other wheel and can be moved across a support surface by energizing the fly wheel. When the appendage members are in the extended position, they contact the support surface such that the body is then supported by the appendage members. The fly wheel is connected to the appendage members via a gear train and appropriate crank disks and crank followers. Motion of the fly wheel can be transferred via the gear train, the crank disks and the crank followers to the appendage members so as to move the appendage members with respect to the body. When the body is so supported by the appendage members when they are in their extended position and motion is transferred to them from the fly wheel, the toy walks across a support surface on the appendage members.

12 Claims, 15 Drawing Figures

20
42
40
38
62
64
56
54
52
30
28
98
50
24
26

42
20
40
38
62
64
56
52
54
30
28
98
50
26
24

FIG. 6A
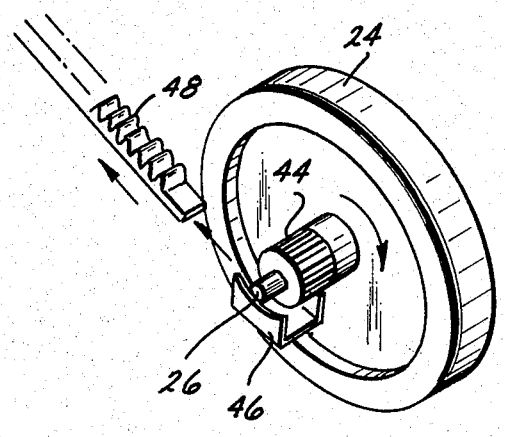
FIG. 12
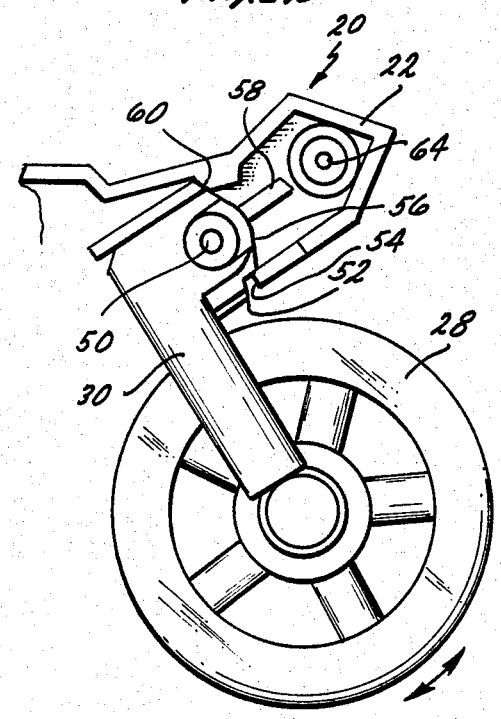
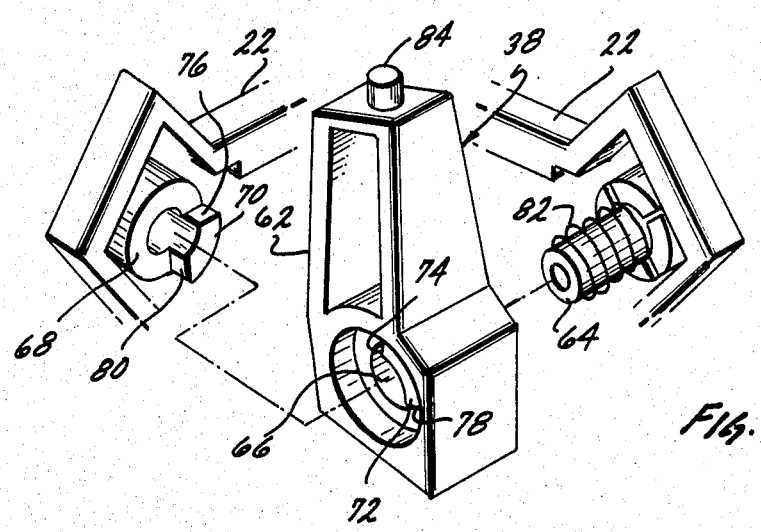
FIG. 13

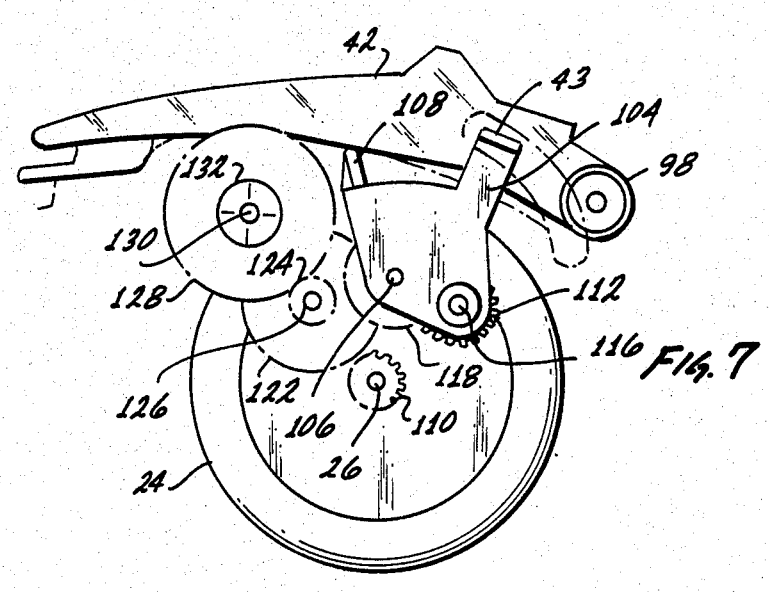
Fig. 7
Fig. 8
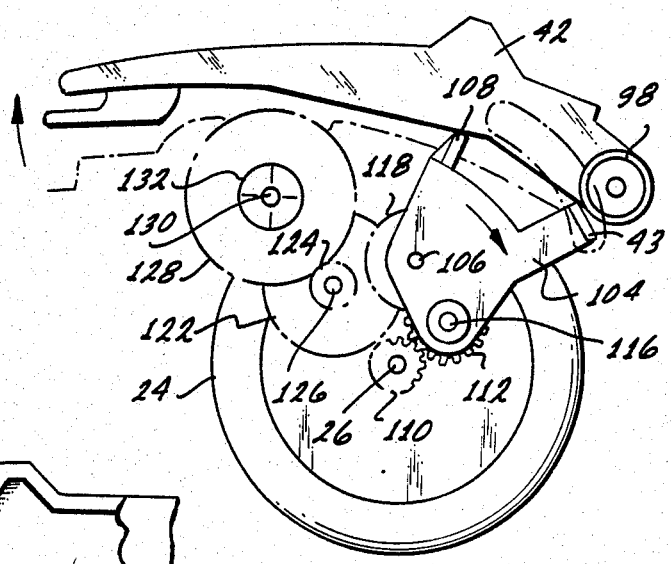
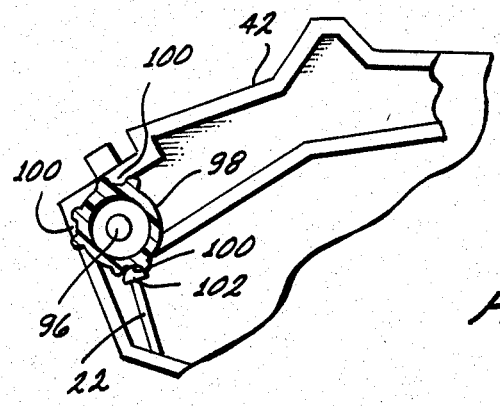
Fig. 11

40
20
38
160
152
138
146
180
162
158
162
176
168
174
170
164
148
42
164
144
26
28
24
36R
34R 178
160
152
144
164
146
158
176
162
168
180
174
164
170
162
138
172
148
34R
36R

TOY HAVING TWO MODES OF LOCOMOTION

BACKGROUND OF THE INVENTION

This invention is directed to a toy which is capable of moving across a support surface both via a rolling motion on wheels wherein one of the wheels is a fly wheel and via a walking motion on appendage members which are oscillated with respect to the body by motion transferred to them by the fly wheel. The appendage members are pivotable on the body between a retracted and an extended position. They are moved with respect to the body by the fly wheel only when in the extended position.

A variety of toys are known which have interchangeable or detachable parts such that these toys can be assembled in a variety of configurations. Certain of these types of toys are capable of being assembled in a configuration wherein the toy is supported by wheels and is propelled by rolling across a support surface. In other configurations, they can be assembled so as to include articulated members which are capable of moving with respect to the body of the toy. These toys, however, all require assembly and disassembly of certain of the components to change between the above noted two configurations.

As with other toys which are made up of a plurality of parts, the toys described in the previous paragraph are susceptible to becoming disjointed, with parts scattered and lost, such that the child is no longer able to play with the toy in the manner originally intended. While assembly and disassembly of the toy in itself provides a useful learning experience for a child, in some instances it is preferrable for the child to be able to instantaneously switch from one configuration of the toy to the second without having to resort to assembly and disassembly of the toy. Again, the above referred to toys do not lend themselves to this type of play.

BRIEF DESCRIPTION OF THE INVENTION

In view of the above, it is a broad object of this invention to provide a toy which has two modes of locomotion. It is a further object of this invention to provide a toy which has parts which are easily and quickly convertible from a configuration capable of supporting one of the modes of locomotion to a configuration capable of supporting the other of the modes of locomotion. It is a further object of this invention to provide a toy which is simple and convenient to use yet is sophisticated enough to maintain the interest of the child and to stimulate the child in imaginative play. It is a further object of this invention to provide a toy which, because of its method of construction and engineering principles incorporated therein, is capable of a long and useful lifetime, yet is economical to the consumer.

These and other objects, as will become evident from the remainder of this specification, are achieved in a movable toy which comprises: a body; a fly wheel rotatably mounted on said body; means for rotating said fly wheel, said means operatively associatable with said fly wheel so as to energize said fly wheel; a wheel rotatably mounted on said body, together said fly wheel and said wheel rotatably supporting said body on a support surface; at least two appendage members having ends, said appendage members pivotably attaching to said body about one of their respective ends so as to pivot between a retracted position wherein said body is supported by said fly wheel and said wheel and an extended position wherein the other of said respective ends of said appendage members contacts said support surface, said appendage members of a sufficient size so as when said appendage members are in said extended position and said other of their respective ends contacts said support surface, said fly wheel and said wheel do not contact said support surface; motion transfer means operatively associated between said fly wheel and said appendage members, said motion transfer means for transferring motion from said fly wheel to said appendage members so as to oscillate said appendage members back and forth with respect to said body when said appendage members are in said extended position.

In the illustrative embodiment of the invention, the toy is provided with four appendage members such that it is capable of mimicking a four-legged creature in one of its modes of locomotion. These appendages are so placed on the toy such that in a first configuration the toy has distinct character differences from the character of the toy when the appendages are in a second configuration. For the illustrative embodiments, in one of the configurations, the toy assumes a motorcycle like appearance and in a second configuration assumes the appearance of a hybrid like creature, half machine, half animal.

In this illustrative embodiment, each of the appendages are rotatably mounted to the body via an axle member. A detent element is formed as a part of each of the appendages and is so placed on the appendage so as to rotate about the center of rotation of the appendage about its respective axle. The motion transfer means includes an appropriate detent engaging means for each of the detents which is capable of engaging the detent when the appendage is in the extended position with motion of the fly wheel transferred to the appendage via interaction of the detent engagement means with the detent.

A gear train is utilized to transfer motion from the fly wheel to appropriate crank disks having crank pins thereon. Slotted members which have the respective detent engagement means attached to them engages the crank pin so as to be moved in response to rotation of the crank disk via motion propagated to it from the fly wheel via the gear train.

BRIEF DESCRIPTION OF THE DRAWINGS

This invention will be better understood when taken in conjunction with the drawings wherein:

FIG. 6*a* is an isometric view of one of the components of FIG. 6 showing the method of energizing that component;

FIG. 7 is a fragmentary elevational view of certain of the components of the toy showing these components in a first or "off" configuration;

FIG. 8 is a view similar to FIG. 7 however showing certain of the components in a further, "on" configuration;

FIG. 11 is a fragmentary elevational view of certain components seen in the upper left hand portion of FIGS. 3 and 4;

FIG. 12 is a fragmentary elevational view of certain components seen in the right hand portions of FIGS. 3 and 4;

FIG. 13 is a fragmentary exploded view of certain of the components seen in the upper right hand portion of FIGS. 3 and 4.

Figure 1:
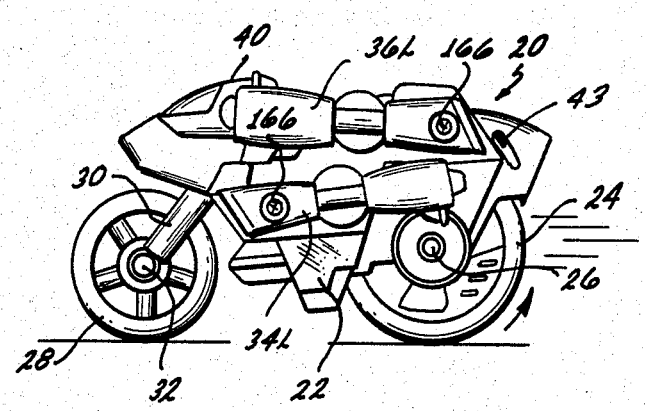
FIG. 1 is an elevational view of a toy of this invention showing the toy in a first configuration.

The invention described in this specification and illustrated in the drawings utilizes certain principles and/or concepts as are set forth in the claims appended to this specification. Those skilled in the toy arts will realize that these principles and/or concepts are capable of being utilized in a variety of embodiments which may differ from the exact embodiment utilized for illustrative purposes herein. For this reason, this invention is not to be construed as being limited to only the illustrative embodiment, but should only be construed in view of the claims.

DETAILED DESCRIPTION OF THE INVENTION

Figure 2:
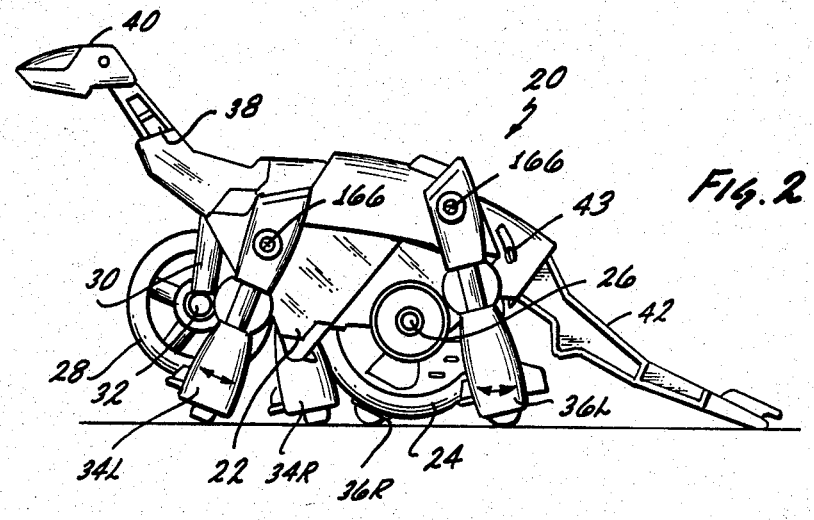
FIG. 2 is an elevational view similar to that of FIG. 1 except the toy of FIG. 1 is shown in a second configuration.

In FIG. 1 a toy 20 is shown in a first configuration, and in FIG. 2 in a second configuration. The first configuration of FIG. 1 is much like a toy motorcycle, while the second configuration of FIG. 2 is that of a hybrid between a machine and an animal. The configuration of FIG. 1, that is the motorcycle configuration, is propelled across a support surface on the two wheels much like a motorcycle. The configuration of FIG. 2 moves in an entirely different manner. Its movement is that of a walking motion about the four legs of the hybrid structure.

The toy 20 includes a chassis or body 22 which has a fly wheel 24 mounted to it via a rear axle 26. A front wheel 28 is mounted to a bifurcated fork 30 via a front axle 32. The fork 30 attaches to the chassis 22 so as to move in a manner to bring the front wheel 28 toward or away from the fly wheel 24 as hereinafter explained.

Left and right front legs 34-L and 34-R are attached to the body 22 as hereinafter explained as are left and right rear legs 36-L and 36-R. Each of the legs 34-L and 34-R and 36-L and 36-R are elongated members having ends with one of their ends attaching to the body 22 and the other of their ends positionable in a downward manner so as to support the body 22 on a support surface, lifting both of the fly wheel 24 and the front wheel 28 upwardly from the support surface when the toy 20 is placed into the configuration seen in FIG. 2. A neck member 38 having a head member 40 attached thereto pivots out from the body 22 when in the configuration of FIG. 2 and a tail member 42 does likewise.

When in the configuration of FIG. 1, i.e., the motorcycle configuration, the legs 34 and 36 are moved to a retracted position wherein they lie almost parallel with one another along the sides of the body 22. The head 40 folds back on the neck 38 which in turn folds back onto the body 22 so as to position the head 40 right over the terminus of the fork 30 with the body 22. The tail 42 folds up and over along the top of the back of the body 22. When so configured as the motorcycle of FIG. 1, the totality of the toy 20 is supported on the front wheel 28 and the fly wheel 24. It can move across a support surface by energizing the fly wheel 24 as hereinafter explained allowing the fly wheel 24 to propel the toy across a support surface.

When it is desirable to put the toy 20 into the extended configuration of FIG. 2, the front and rear legs 34 and 36 are rotated so as to extend downwardly. The front wheel 28 is pushed back toward the fly wheel 24 and this in turn lifts the neck 38 up slightly from the body 22 such that it and the head 40 can be grasped and rotated to the position seen in FIG. 2. A switch 43 is moved from the position seen in FIG. 1 to he position seen in FIG. 2. This accomplishes several things. First, it lifts the tail 42 slightly such that it can be grasped and rotated away from the body 22 to the configuration seen in FIG. 2. Secondly, this engages certain internal mechanism such that the rotation of the fly wheels 24 is transferred via a gear train to other components which ultimately cause oscillation of the legs 34 and 36 with respect to the body 22 such that the toy as seen in the configuration of FIG. 2 is propelled across a support surface in a walking like manner on the four legs 34L, 34R, 36L and 36R. When in the configuration of FIG. 2 as noted above, both the fly wheel 24 and the front wheel 28 are lifted upwardly from the support surface with the totality of the toy 20 being supported on the support surface by the legs 34 and 36.

Figure 6:
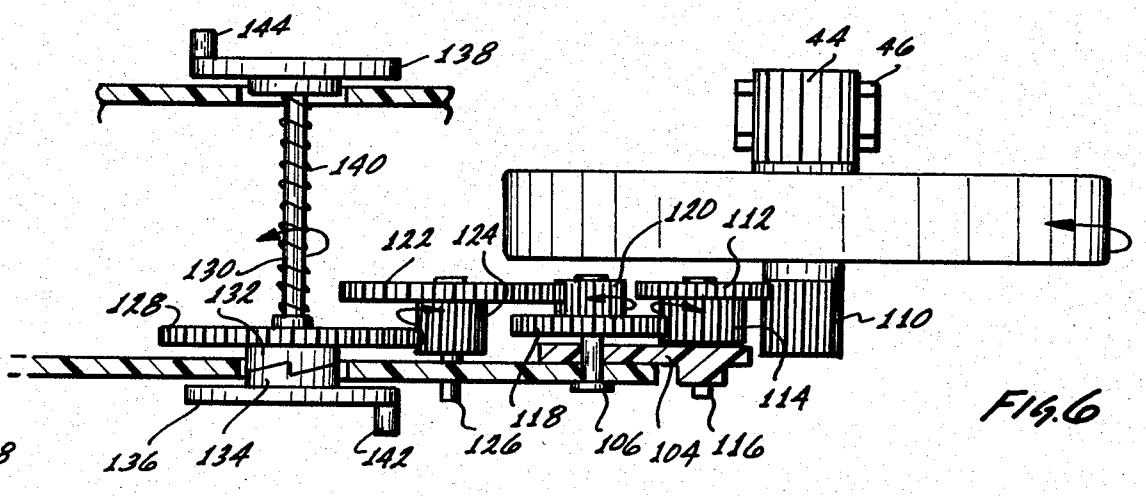
FIG. 6 is a plan view about the line 6—6 of FIG. 5.

Referring to FIG. 6*a*, the fly wheel 24 is exploded out of the remainder of the toy 20. Formed on one side of the fly wheel 24 about the fly wheel axle 26 is a fly wheel energizing pinion 44. A small "U" shaped bracket 46 formed as a portion of the body 22 is positioned directly below the fly wheel energizing pinion 44. A flexible gear rack 48, only a portion of which is shown in FIG. 6*a*, slides into the "U" shaped bracket 46 through appropriate openings formed in the body 22 of the toy 20 and engages the pinion 44. The gear rack 44 is slid all the way into the bracket 46 and then is rapidly extracted from the body 22 of the toy 20 by moving the gear rack in the direction opposite to that when it was inserted into the bracket 46. In rapidly extracting the flexible gear rack 48, the teeth on the gear rack mesh with the pinion 44 so as to rotate the pinion 44 and the fly wheel 24 attached thereto to energize the fly wheel. When so energized, the fly wheel is capable of propelling the toy 20 either in the configuration seen in FIG. 1 as a motorcycle or in the configuration seen in FIG. 2 as the hybridized machine-like animal. In the configuration of FIG. 1, the fly wheel propels the toy 20 by direct contact of the fly wheel with the support surface, and in the configuration of FIG. 2, it propels the toy 20 by transfer of the motion of the fly wheel 24 through other components to the front and rear legs 34 and 36.

Figure 3:
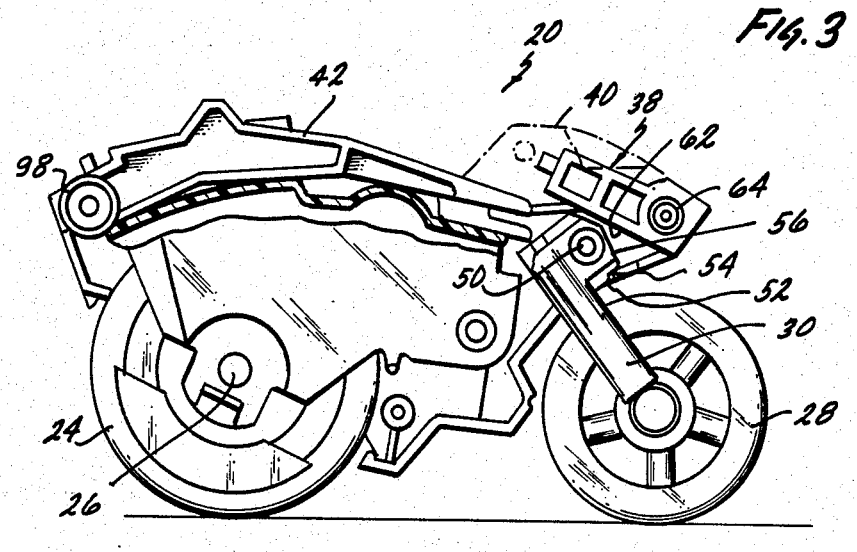
FIG. 3 is an elevational view similar to FIG. 1 except certain portions of the toy toy of FIG. 1 have been removed, with other portions sectioned so as to show certain internal construction, and further with certain of the components of the toy shown in the same spatial configuration as in FIG. 1.
Figure 4:
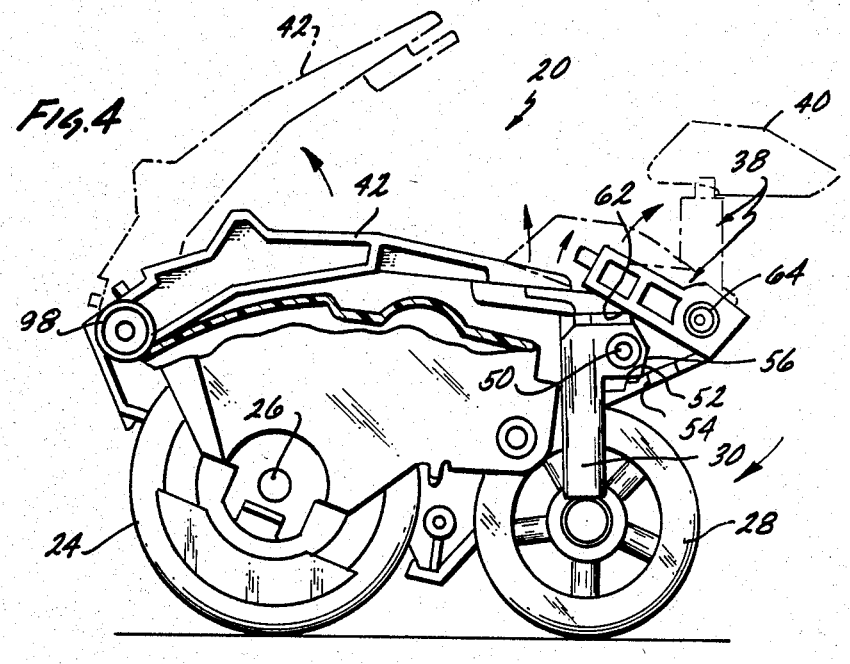
FIG. 4 is view similar to FIG. 3 except certain of the components are shown in solid line in a slightly different spatial configuration that that seen in FIG. 3 and in phantom line in even a further spatial configuration from that seen in FIG. 3.

Before discussing transfer of motion of the fly wheel 24 to the legs 34 and 36, the attachment of the various parts of the toy 20 to the body 22 will be described. Referring now to FIGS. 3 and 4, it can be seen that the front fork 30 is attached to the body 22 via an axle 50. This is shown in greater detail in FIG. 12. When the toy 20 is in the motorcycle configuration of FIG. 1, a surface 52 on the fork 30 abutts against a surface 54 on the body 22 so as to position the fork 30 and the front wheel 28 in a downwardly and outwardly extending position. It is held in this position and other sequel positions noted below by frictional fit between the front edge 56 of the fork 30 and a small web 58 formed on the inside of the body 22.

Figure 5:
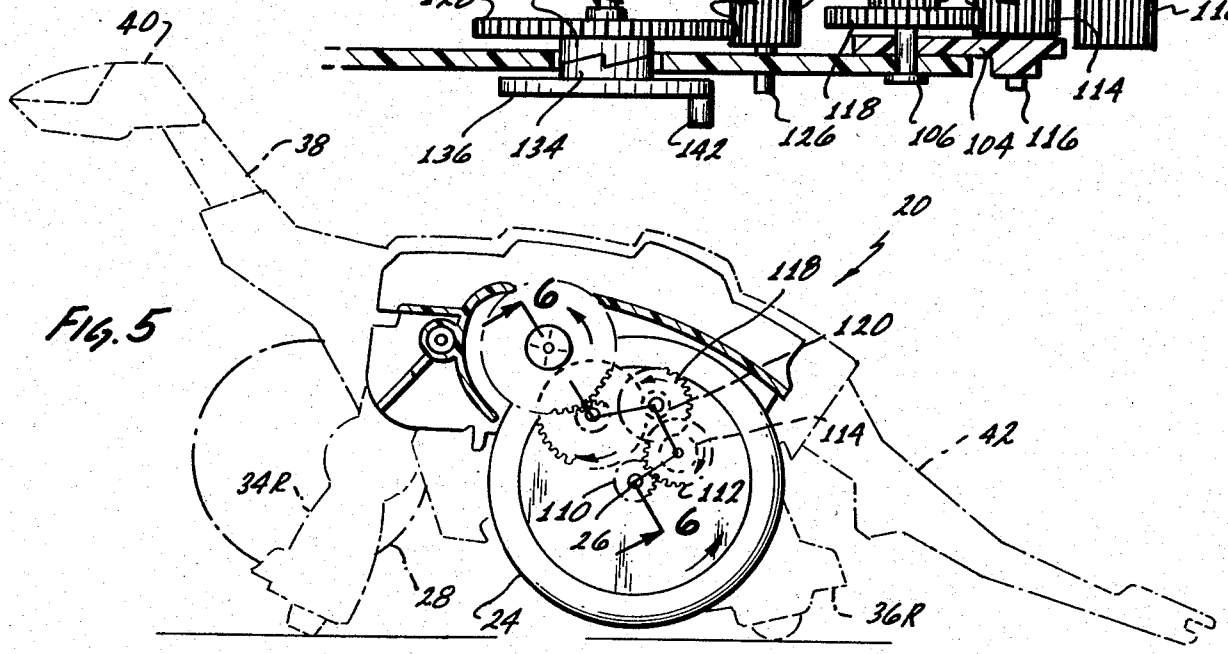
FIG. 5 is a side elevational view of the configuration shown in FIG. 2 with certain parts shown in section and others shown in phantom so as to illustrate certain internal mechanism located within the interior of the toy.

When the front wheel 28 and the fork 30 are pulled backwardly toward the fly wheel 24, a further surface 60 on the fork 30 engages a surface 62 on the neck member 38. As seen in FIG. 4, when the surface 60 engages the neck member 38, it pushes the neck member 38 such that it rotates about its mounting axle 64 which attaches it to the body 22. Once it is partly extended as seen in FIG. 4, it and the head 40 can be grasped so as to rotate the neck member 38 to the position seen in phantom line in FIG. 5 and in solid line in FIG. 2.

Referring now to FIG. 13, portions of the body 22 and the neck member 38 are shown. The axle 64 is integrally formed with the right hand side of the body member 22 as seen in FIG. 3 and it projects through an opening 66 formed in the neck member 38 and meets with a boss 68 formed on the other half of the body 22. The boss 68 includes an arcuate sector element 70. A further arcuate sector element 72 is positioned within the opening 66. When the neck 38 is in the configuration as seen in FIG. 1, surface 74 of the element 72 abutts against surface 76 of the element 70 and when the neck member 38 is in the configuration as seen in FIG. 2, surface 78 of the element 72 abutts against surface 80 of the element 70. These surfaces form a first and second limit to the rotation of the neck member 38 about the axle 64. A small spring 82 which is compressed between the right hand body member 22 seen in FIG. 3 and the neck member 38 frictionally retains the neck member 38 in whatever position it is rotated to on the axle 64.

Figure 14:
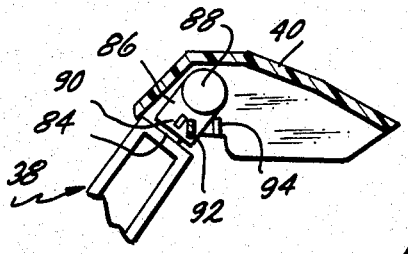
FIG. 14 is a further fragmentary elevational view of the component seen in the upper right hand portion of FIG. 4.

As is seen in FIGS. 3, 4 and 12, the neck member 38 includes a small boss 84 on its end which fits into a connector 86 which is seen in FIG. 14. The connector 86 is pivotally mounted to the head member 40 via pin 88. The totality of the head 40 and connector 86 can pivot about the boss 84 so as to rotate the head 40 360° about the neck 38 and further the head 40 can rotate about the pin 88 allowing the head 40 to tilt about the neck 38. The connector 86 has a small slot 90 on both sides of it, only one being seen in FIG. 14, the other being hidden but positioned in a similar position on the other side of the connector 86. The head includes a detent 92 formed on its inside surface on one side and detent 94 formed on its inside surface on the other side. The detent 92 is in a different relative position with respect to the slots 90 than is the detent 94. When the head 40 is extended away from the neck member 38 in the second configuration, it is held in position by locking of the detent 92 in one of the slots 90 and when it is extended inwardly toward the neck member 38 in the configuration of FIG. 1, it is held in position by locking of the detent 94 with the other unseen slot on the opposite side of the connector 86.

Referring now to FIG. 11, the tail member 42 is held to the body 22 via a tail axle 96. The tail member 42 includes a boss 98 formed as a part thereof located within the interior of the body 22. The boss 98 includes several openings collectively identified by the numeral 100 formed on its outside surface. A small finger 102 formed as a part of the inside surface of the body 22 is positioned so as to engage with the openings 100 as the boss 98 rotates about the tail axle 96 in response to rotation of the tail 42 about that axle. Interaction of the finger 102 in the openings 100 holds the tail 42 in one of three different configurations with respect to the body 22. One of these is closed as is seen in the configuration of the toy 20 illustrated in FIG. 1 and the other is an open or extended position as is seen for the configuration of the toy in FIG. 2. The third would be an intermediate position as per the phantom line of FIG. 4.

To assist in raising the tail member 42 out of the body from the configuration seen in FIG. 1, and also to engage a gear train as hereinafter explained, a shift member 104 is utilized. The shift member 104 has the off/on switch 43 formed as a part thereof. The shift member 104 is pivoted to the body 22 via an axle 106. It includes a tail engaging projection 108 formed thereon which engages the bottom of the tail member 42 when the switch 43 is slid from the position seen in FIG. 1 to that of FIG. 2. This lifts the tail member 42 upwardly such that the finger 102 is disengaged from the opening 100 which holds the tail member 42 tight against the body 22 in the configuration of FIG. 1. This allows the user of the toy 20 to grasp the tail member 42 to continue rotating it to a new configuration.

Referring now to FIGS. 5, 6, 7 and 8, the gear train which assists in transferring motion of the fly wheel 24 to the legs 34 and 36 is shown. On the opposite side of the fly wheel 24 from the pinion 44 is a second pinion 110. This pinion 110 is also mounted about the rear axle 26 and rotates in conjunction with the fly wheel 24. A combination gear having a spur gear 112 and a pinion gear 114 is mounted about an axle 116 to the shift member 104. The spur gear 112 is positioned so as to engage the pinion 110 on the fly wheel 24 when the shift member 104 is moved to the position from FIG. 7 to the position of FIG. 8. A further combination gear including spur gear 118 and pinion 120 are rotated about the axle 106 by which the shift member 104 was noted as being attached to the body 22. The spur gear 118 meshes with the pinion 114 so as to be rotated by it when the spur gear 112 is engaged with the pinion 110.

A further combination gear including spur gear 122 and pinion 124 are mounted about axle 126 in a position such that the spur gear 122 meshes with the pinion 120. A large spur gear 128 which rides on axle 130 but is not attached thereto meshes with the pinion 124. The spur gear 128 includes a re-entrant gear 132 formed on its outside surface which meshes with a re-entrant gear 134 formed on the inside surface of a crank disk 136. The crank disk 136 is fixedly mounted to the axle 130.

On the opposite end of the axle 130 from the crank disk 136 is a second crank disk 138 also fixedly mounted to the axle 130. The two crank disks 136 and 138 rotate in conjunction with the axle 130. A spring 140 wrapped around the axle 130 extends between the crank disk 138 and the spur gear 128. It pushes against both the spur gear 128 and the re-entrant gear 132 to engage re-entrant gear 132 with the re-entrant gear 134 such that motion imparted to the spur gear 128 via the gear train from the pinion 110 is transferred to the crank disk 136 and the axle 130 and the crank disk 138. The two re-entrant gears 132 and 134 prevent damage to any of the gears should the crank disks 136 and 138 be fixed by holding the legs 34 and 36 which can be fixed to the crank disk 136 and 138 (as hereinafter explained) while simultaneously rotating the fly wheel 24. The re-entrant gears 132 and 134 will slip with respect to one another, compressing the spring 140 to avoid damage to any components.

The crank disk 136 includes a crank pin 142 formed on its surface and the crank disk 148 includes a crank pin 144 formed on its surface. The two crank pins 142 and 144 are 180° out of phase with respect to one another.

Figure 9:
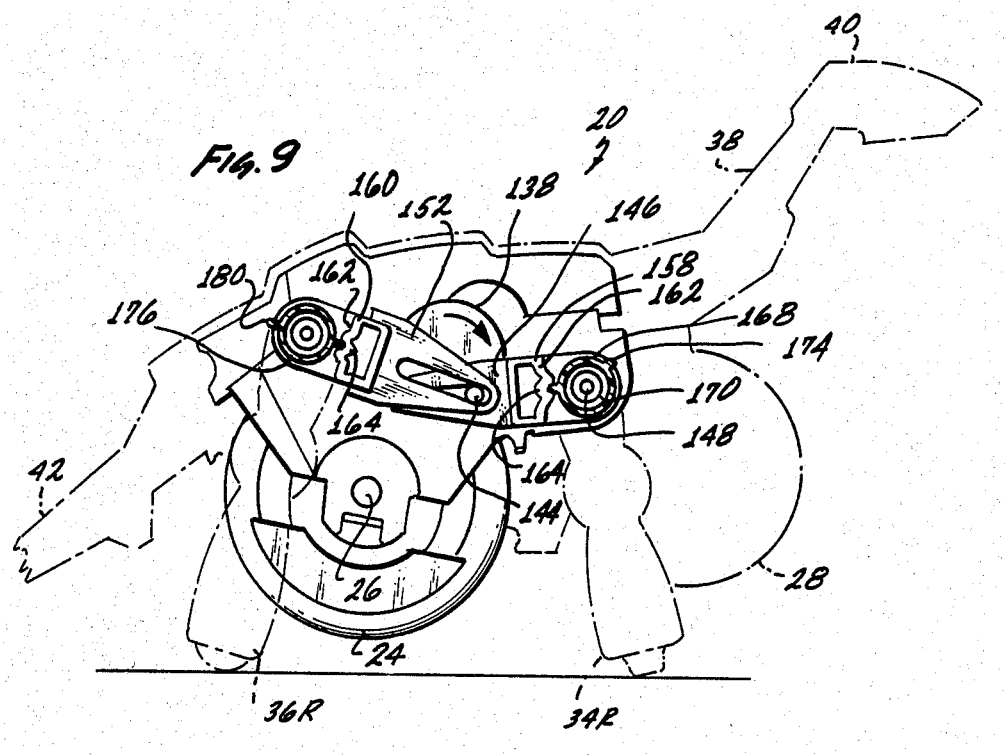
FIG. 9 is a side elevational view in section similar to FIG. 5 showing other internal components.
Figure 10:
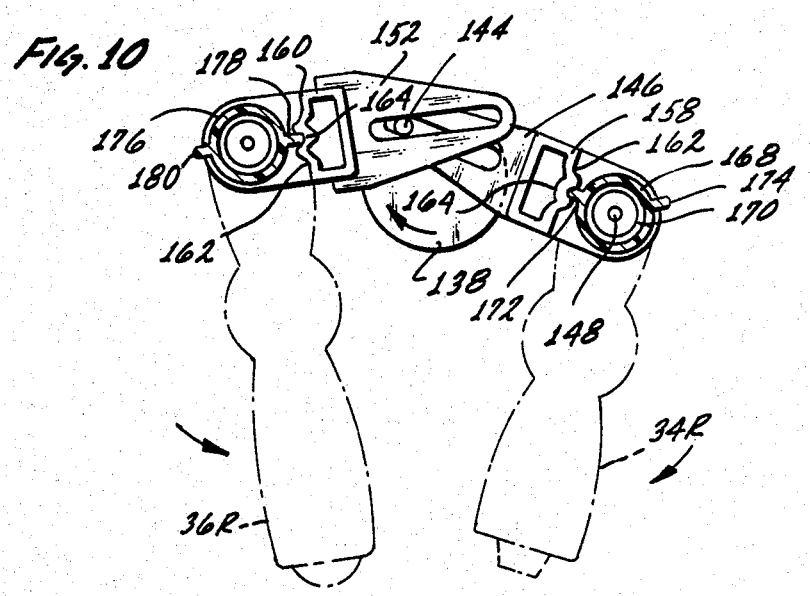
FIG. 10 is a fragmentary elevational view of certain of the components of FIG. 9 showing these components in a different spatial relationship than as seen in FIG. 9.

FIGS. 9 and 10 show transfer of motion from the crank disk 138 to the right legs 34-R and 36-R. A front crank follower 146 is mounted about an axle 148 to the body 22. The front crank follower 146 includes a slot 150 which fits over the crank pin 144. Rotation of the crank 138 causes the crank pin 144 to rotate and to slide within the slot 150 to oscillate the front crank follower 146 upwardly and downwardly in an arc about the axle 148. In a similar manner, a rear crank follower 152 is pivoted about a rear axle 154 and has a slot 156 which also fits over the crank pin 144.

The crank follower 146 and 152 carry small squarish shaped spring members 158 and 160 respectively. These are formed out of lightweight plastic which has a certain springiness to it such that the front surface, collectively identified by the numeral 162 for both the members 158 and 160 can be moved inwardly into the body of the spring member 158 and 160 toward the crank pin 144. The front surfaces 162 are shown to include a small indent collectively identified by the numeral 164 which serve as detent engagement means.

The front leg 34R is attached via a screw, (it and other screws being collectively identified by the numeral 166) to a boss 168 which fits over a further boss 170 formed as a part of the front crank follower 146. This centers the boss 168 about the axle 148 and in so doing also attaches the upper end of the front leg 34R about the center of rotation of the axle 148. The boss 168 includes two detents 172 and 174 formed thereon. In FIGS. 9 and 10 the detent 172 is shown located within the indent 164 on the spring member 158. This fixes the boss 168 and thus the front leg 34R attached thereto to the front crank follower 146 such that as the front crank follower 146 oscillates about the axle 148 its movement is transferred to the leg 34R to move it. In a like manner, the rear leg 36R is attached to a similar boss 176 having detents 178 and 180 formed thereon which interact with the spring member 160 in the rear crank follower 152. When the legs 34 and 36 are rotated to he configuration seen in FIG. 1, neither of the detents 172 and 174 for the front leg 34 engage the spring member 158 nor the detents 178 or 180 for the rear leg 36 engages the spring member 160.

The legs 34-L and 36-L on the other side of the body 22 are connected to the crank disk 136 by equivalent parts as are the ones described for legs 34-R and 36-R.

Motion will be propagated from the fly wheel 24 to the legs 34 and 36 only when both the shift member 104 is moved to the configuration seen in FIG. 8 and the appropriate detents attaching to the respective legs 34 or 36 engage the respective spring members 158 and 160. If the legs 34 and 36 are positioned as per FIG. 2, but the switch 43 is in the position seen in FIG. 1, motion will not be transferred from the fly wheel 24 to the legs 34 and 36. If switch 43 is positioned as seen in FIG. 2, the legs 34 and 36 are in the configuration as seen in FIG. 1 even though motion is propagated from the fly wheel 24 to the front and rear crank followers 146 and 152, no motion will be propagated to the legs 34 and 36.

The legs 34 and 36 can be positioned in a further configuration not shown in FIG. 1 or 2. In this configuration, the legs 34 and 36 would be rotated about 180° from that seen in FIG. 2 positioning the detent 174 on the boss 168 in the indent 168 on the spring member 158. In a like manner, the detent 180 on the boss 176 would be engaged with the spring member 160. In this manner, the toy 20 would be able to walk upside down. Of course, the head 40 and the neck 38 would have to be positioned in the configuration seen in FIG. 1 so as not to interfere with support of the toy 20 by the legs 34 and 36 when they were in that configuration. This essentially allows the toy 20 to walk in a position or configuration which is essentially upside down from that seen in FIG. 2.

I claim:

1. A movable toy which comprises:

a body;

a fly wheel rotatably mounted on said body;

means for rotating said fly wheel, said means operatively associatable with said fly wheel so as to energize said fly wheel;

a wheel rotatably mounted on said body, together said fly wheel and said wheel rotatably supporting said body on a support surface;

at least two appendage members having ends, said appendage members pivotably attaching to said body about one of their respective ends so as to pivot between a retracted position wherein said body is supported by said fly wheel and said wheel and an extended position wherein the other of said respective ends of said appendage members contacts said support surface, said appendage members of a sufficient size so as when said appendage members are in said extended position and said other of their respective ends contacts said support surface, said fly wheel and said wheel do not contact said support surface;

motion transfer means operatively associated between said fly wheel and said appendage members, said motion transfer means for transferring motion from said fly wheel to said appendage members so as to oscillate said appendage members back and forth with respect to said body when said appendage members are in said extended position.

2. The toy of claim 1 including:

four of said appendage members.

3. The toy of claim 1 wherein:

each of said appendage members includes an axle means for rotatably mounting said appendage members to said body;

each of said appendage members further includes at least one detent element fixed to said appendage member at a position so as to rotate around the center of rotation of the respective axle means of said appendage member in conjunction with rotation of said appendage member about its respective axle means;

said motion transfer means including detent engagement means for engaging with each of the detents of the respective appendage members so as when said detent engagement means is engaged with the respective detent element of said respective appendage members motion of said fly wheel is transferred to the respective detent element to move said respective detent element and the appendage member attached thereto.

4. The toy of claim 3 wherein:

said motion transfer means further includes gear train means for transferring motion from said fly wheel to said respective detent engagement means.

5. The toy of claim 4 wherein:

said motion transfer means further includes crank disk means, said crank disk means associated with and rotated by said gear train means in response to rotation of said fly wheel.

6. The toy of claim 5 wherein:

said detent engagement means operatively associated with said crank disk means so as to be moved in response to rotation of said crank disk means;

said motion transfer means further including crank disk means follower means operatively associated with said crank disk means, said detent engagement means located on said crank disk follower means so as to be moved in response to movement of said crank disk follower means by said crank disk means.

7. The toy of claim 6 wherein;

said detent engagement means includes a plurality of spring members equal in number to the number of said appendage members, each of said spring members capable of engaging with a respective detent element and transferring motion to said respective detent element.

8. The toy of claim 7 wherein:

said motion transfer means further includes crank following means, said crank following means operatively associated with said crank disk means so as to be moved by said crank disk means in response to rotation of said crank disk means;

each of said spring members operatively associated with said crank following means so as to move in conjunction with said crank following means.

9. The toy of claim 8 wherein:

said crank following means includes a plurality of crank following members equal in number to the number of said appendage members.

10. The toy of claim 1 including:

at least one decorative member movably attaching to said body, said decorative member positionable in a first position when said appendage members are in said retracted position and positionable in a second position when said appendage members are in said extended position.

11. The toy of claim 10 including:

four of said appendage members.

12. The toy of claim 11 wherein:

each of said appendage members includes an axle means for rotatably mounting said appendage members to said body;

each of said appendage members further includes at least one detent element fixed to said appendage member at a position so as to rotate around the center of rotation of the respective axle means of said appendage member in conjunction with rotation of said appendage member about its respective axle means;

said motion transfer means including detent engagement means for engaging with each of the detents of the respective appendage members so as when said detent engagement means is engaged with the respective detent element of said respective appendage members motion of said fly wheel is transferred to the respective detent element to move said respective detent element and the appendage member attached thereto.

* * * * *